US006200106B1

(12) United States Patent
Martin et al.

(10) Patent No.: US 6,200,106 B1
(45) Date of Patent: Mar. 13, 2001

(54) FAN ASSEMBLY WITH A FAN LOCKING DEVICE FOR AN AUTOMOTIVE FLUID FRICTION FAN CLUTCH

(75) Inventors: Hans Martin, Stuttgart; Franz A. Bierbrauer, Schwalbach, both of (DE); Rudolf Wichtl, Garsten; Wolfgang Kuttler, Gruenberg, both of (AT)

(73) Assignees: Behr GmbH & Co., Stuttgart; Magenta GmbH Systemlieferant Fuer Elektromagnetische Baugruppen, Heusweiler; Bayerishce Motoren Werke Aktiengesellschaft, Munich, all of (DE)

( * ) Notice: Subject to any disclaimer, the term of this patent is extended or adjusted under 35 U.S.C. 154(b) by 0 days.

(21) Appl. No.: 09/000,868

(22) Filed: Dec. 30, 1997

Related U.S. Application Data

(63) Continuation of application No. 09/000,868, filed on Dec. 30, 1997, now abandoned.
(60) Provisional application No. 60/025,865, filed on Sep. 10, 1996.

(30) Foreign Application Priority Data

May 1, 1996 (DE) ..... 196 17 414
Apr. 18, 1997 (WO) ..... PCT/EP97/01950

(51) Int. Cl.[7] ..... F04B 49/00
(52) U.S. Cl. ..... 417/223; 417/364; 417/214; 123/41.12
(58) Field of Search ..... 417/364, 223, 417/214; 123/41.12

(56) References Cited

U.S. PATENT DOCUMENTS

| | | | | |
|---|---|---|---|---|
| 4,004,198 | * | 1/1977 | Cairo et al. | 317/155.5 |
| 4,222,353 | * | 9/1980 | Abe et al. | 123/41.12 |
| 4,302,156 | * | 11/1981 | LaFlame | 416/169 |
| 4,550,695 | * | 11/1985 | Kikuchi et al. | 123/41.12 |
| 5,025,906 | * | 6/1991 | O'Neil et al. | 192/58 B |

* cited by examiner

*Primary Examiner*—Timothy S. Thorpe
*Assistant Examiner*—Timothy P. Solak
(74) *Attorney, Agent, or Firm*—Foley & Lardner

(57) ABSTRACT

The present invention relates to a fan for an internal combustion engine. The fan has a locking device for a fluid friction clutch in the form of a pivoting hook that may be mounted subsequently at a fixed location using a holding device and may be triggered using an electromagnet. The electromagnet may be accommodated in the circuit of an ignition lock such that when the engine is started, the fan wheel is prevented from rotating unintentionally.

14 Claims, 3 Drawing Sheets

FAN ASSEMBLY WITH A FAN LOCKING DEVICE FOR AN AUTOMOTIVE FLUID FRICTION FAN CLUTCH

This is a continuation of U.S. application Ser. No. 09/000868, filed on Dec. 30, 1997, now abandoned.

The benefit is hereby claimed of the right to an earlier effective filing date based on PCT/EP97/01950 as provided for in 35 USC §120 and claims priority under 35 U.S.C. §119(e) based on U.S. Provisional Application Serial No. 60/025,865, filed Sep. 10, 1996.

TECHNICAL FIELD OF THE INVENTION

The invention relates to a fan for an internal combustion engine, with a fluid friction clutch inserted between a drive shaft and a fan wheel and with a locking device intended for the fan wheel and cooperating positively with the housing of the fluid friction clutch, said housing being equipped with the fan blades.

BACKGROUND OF THE INVENTION

A fan arrangement of this type is known from DE 34 20 277 C3. There, the housing of the fluid friction clutch, said housing being equipped with the fan blades, was assigned either a mechanically actuated brake or a mechanically actuated retaining rod, in order to stop the fan wheel completely, for example during a cold start, and thereby prevent the cooling air generated by the co-rotating fan from delaying the heating of the cooling fluid of the internal combustion engine. Both the brake provided there and the positively acting retaining device are actuated via a memory element which changes its shape abruptly at a specific coolant temperature and, since the memory element provided there is a coil, frees the fan wheel to rotate from a specific coolant temperature, while below this coolant temperature, that is to say, for example, during a cold start, it retains the fan wheel. In devices of this type, the drive arrangement, in particular the fluid friction clutch, must be provided correspondingly with a brake or, as proposed there, with a hollow drive shaft, through which an axially displaceable retaining rod is guided. This is complicated and also does not permit subsequent refitting. The changeover operation can also be triggered solely by the coolant temperature, specifically irrespective of the air temperature which controls the supply or discharge of oil to or from the clutch and which is recorded via a bimetal.

OBJECTS OF THE INVENTION

The object on which the present invention is based is to design in a simple way a retaining device of the type mentioned in the introduction, such that a retrofitting of existing fan drives and a control of the retaining device via other parameters of the engine control are possible.

SUMMARY OF THE INVENTION

To achieve this object, in a fan of the type mentioned in the introduction, there is provision for the locking device to be a detent element which engages directly on the outside of the housing of the fluid friction clutch and which can be actuated via an actuating member located in the circuit of the ignition lock and/or triggered by other parameters of the engine control.

By virtue of this design, when the detent element is actuated from the ignition circuit it is then guaranteed, during any starting operation, and, in particular, also during a cold start, that the fan wheel is stationary, so that, on the one hand, if the clutch is still full, the pumping-off operation can proceed as a function of the cooling air temperature, but, on the other hand, a co-rotation of the fan wheel itself when the clutch is empty is also reliably prevented. This design also leaves open the possibility of actuating or releasing the detent element as a function of other signals and, for example, of preceding the detent element with a delay element which, after the ignition has been switched off, in the event that the temperature of the coolant has not yet reached the predetermined value or has fallen short of it again, allows a renewed activation of the retaining device only some time after the fan wheel has come to a stop. Damage to the fan wheel as a result of mechanical interaction with the detent element is ruled out in this way.

In a development of the invention, the actuating member for actuating the detent element can be arranged in an electric circuit, together with the ignition lock and an additional switch which can be triggered by a thermal element for recording the coolant temperature. By virtue of this design, in normal operation the detent element is released when the coolant temperature is sufficiently high.

In a development of the invention, in this design an electromagnet can be provided as an actuating member, the function of said electromagnet being merely to bring the detent element into engagement with the housing of the fluid clutch. The power of such an electromagnet can be very low. There is therefore also the possibility of constructing the electromagnet from two windings which are located in separate circuits and, only when current is applied to them jointly, are capable of actuating the catch hook provided as a detent element. This embodiment affords the possibility of a simple safeguard which rules out an actuation of the retaining device under specific preconditions.

In a development of the invention, there can be provided as a detent element a bolt which engages into the interspace between cooling ribs of the housing of the fluid friction clutch. In a development, this bolt can be designed in a simple way as a catch hook which is pivotable at a fixed location and which is mounted on a holding device which, in particular, is arranged fixedly relative to the engine. This design makes it possible in a simple way for existing fan drives having a fluid friction clutch, the housing of which is usually provided with approximately radially projecting cooling ribs, also to be provided with a detent device while the holding device for the catch hook serving as a detent bolt can be mounted essentially at any desired points wherever room is available in the engine space. The actuation of a catch hook also requires very little electrical energy.

In a particularly advantageous development of the invention, the catch hook can be provided in a hook-like manner with a projecting wing composed of magnetically active material, this wing cooperating with the electromagnet. This design allows very simple actuation, in which the energy consumption for the electromagnet is very low. Finally, the catch hook thus designed can be provided in a simple way with a return spring, and, in order to save as much construction space as possible, the latter can be designed as a leaf spring which is seated firmly on the holding device and runs approximately parallel to the articulated part of the catch hook.

BRIEF DESCRIPTION OF THE DRAWING FIGURES

These and other features, aspects, and advantages of the present invention will become more apparent from the following description, appended claims, and accompanying exemplary embodiment illustrated in the drawings described below.

DETAILED DESCRIPTION OF THE PREFERRED EMBODIMENT OF THE INVENTION

Figure 1:
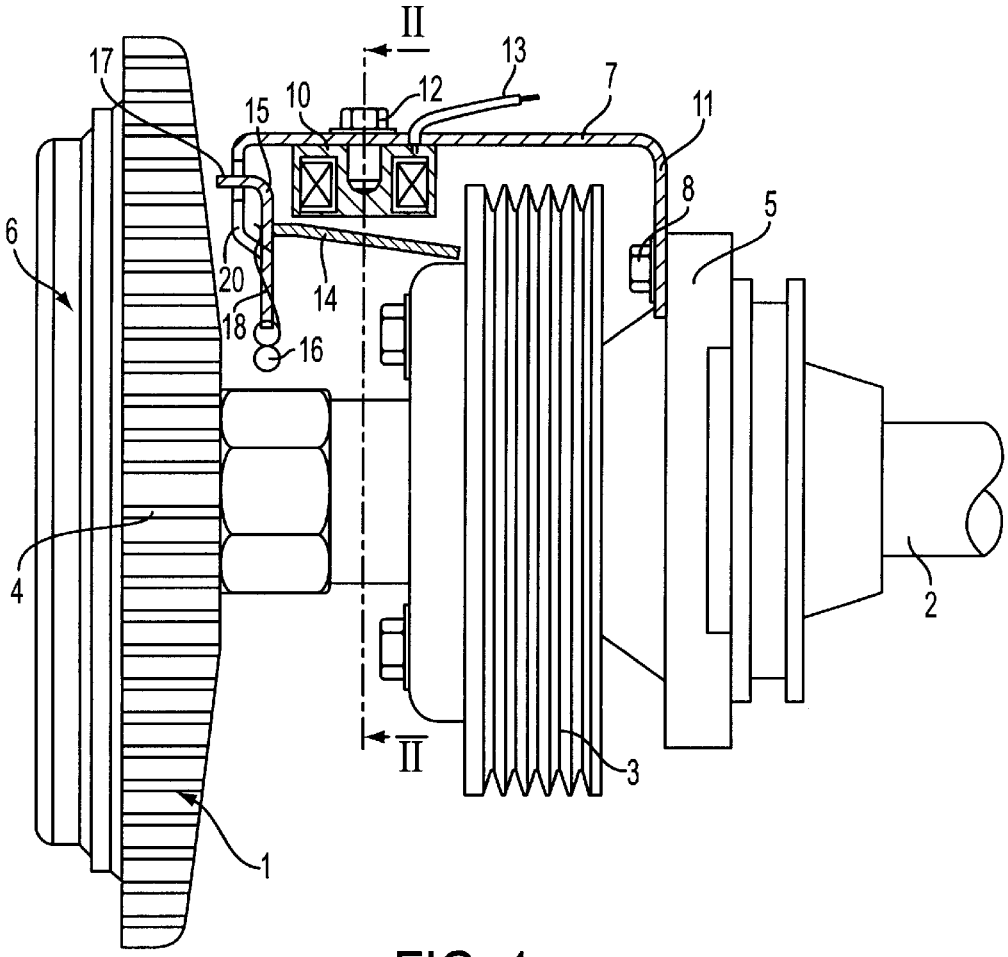
FIG. 1 shows a partially cut away side view of the clutch arrangement for a fan according to the invention, with a locking device in its released position.
Figure 2:
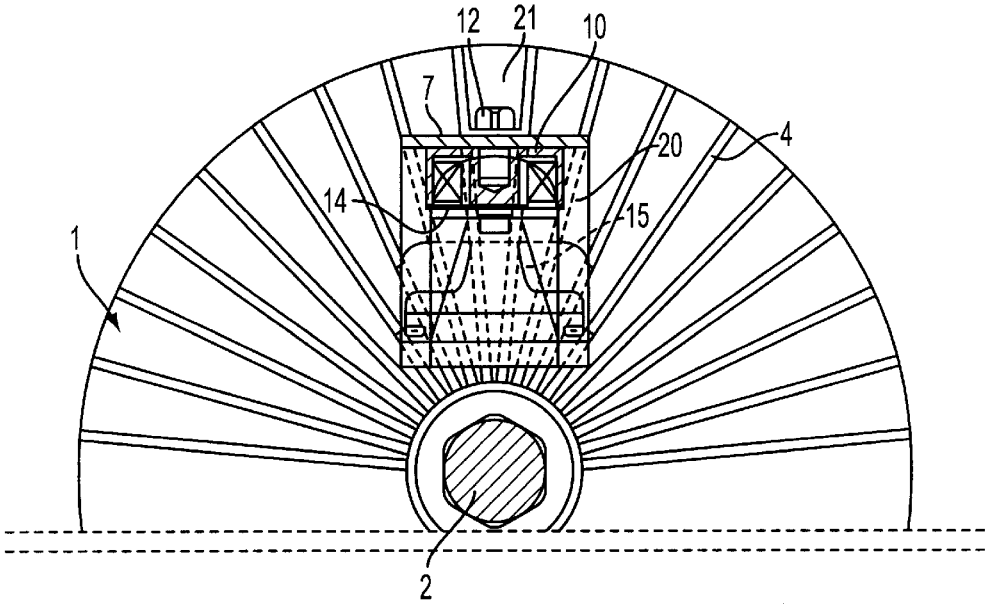
FIG. 2 shows a view of the arrangement according to FIG. 1, as seen in the direction of the sectional line II—II, but with the locking device being in the position according to FIG. 3.

FIGS. 1 and 2 show the clutch housing (1) of a fluid friction clutch (6) known per se, which is driven in a way not shown in any more detail via a central drive shaft (2) or via a V-belt wheel (3) and which induces the housing (1), which is provided with radially extending cooling and reinforcing ribs (4) and with fan blades (not shown), to rotate as a function of the degree of filling of the clutch.

In the exemplary embodiment shown, a water pump (5), which is mounted at a fixed location, for example on the engine block, is also arranged on the drive shaft (2) coaxially relative to the clutch housing (1). The fluid friction clutch ensures in a known way that the fan wheel formed by the housing (1) of the fluid friction clutch (6) rotates more or less rapidly as a function of the cooling air temperature and therefore promotes the flow through a radiator (not shown) arranged in the region in front of the fluid friction clutch (6). This takes place in a known way via a thermocouple which is designed as a bimetal and is assigned to the end face of the fluid friction clutch and which, in a known way, opens an overflow valve between a supply chamber in the fluid friction clutch (6) and a working chamber, so that the working chamber fills at higher temperatures and the clutch housing (1) designed as a fan wheel is taken up by the driven clutch half via shear forces.

Fluid friction clutches of this type generally work satisfactorily. However, on account of the degree of filling which remains even when the valve is closed, they also corotate in the so-called idling mode, where a cooling effect generated by rotating fan blades is undesirable per se. This is the case in particular during a cold start of the engine, in which the engine temperature, that is to say the temperature of the coolant of the engine, should rise as quickly as possible.

According to the invention, therefore, a holding device (7) in the form of an angle bar is screwed to the fixed water pump (5), specifically by means of screws (8) which pass through orifices (9) in a flange part (11) of the holding device (7). The bar-shaped holding device (7) is provided with a screwed-on electromagnet (10) which is of approximately cylindrical design and which is held by a screw (12). The electromagnet (10) supplied with electrical energy via a connecting cable (13) cooperates with a wing (14) projecting from a pivotable catch hook (15) and made from magnetic material, FIG. 1 showing the position of the catch hook (15), in which the electromagnet (10) is not live, whereas FIG. 3 shows the position in which the electromagnet (10) is live (actuated).

Figure 4:
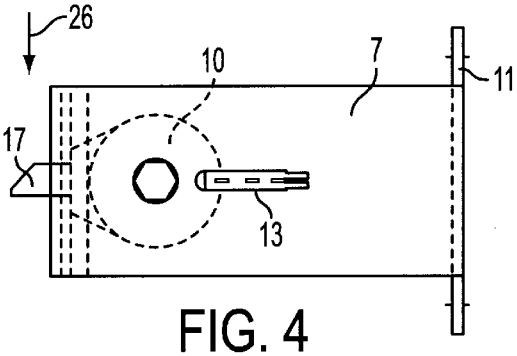
FIG. 4 shows a top view of the locking device of FIG. 3, as seen in the direction of the arrow IV of FIG. 3.
Figure 5:
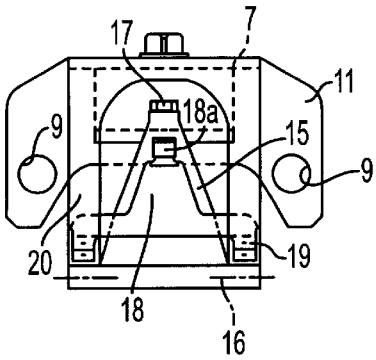
FIG. 5 shows an end view of the locking device according to FIG. 3, as seen in the direction of the arrow 5 of FIG. 3.

As FIGS. 2, 4 and 5 reveal, the catch hook (15) consists of a one-piece sheet metal part which tapers upward from a pivot axis (16) to a catch nose (17). This catch hook (15) is surrounded from both sides by a leaf spring (18) which is firmly fastened by means of rivets (19) to downward-projecting bar parts (20) of the holding device (7) and comes to bear with its upper end **(18*a*) on the hook (15). This leaf spring (18) endeavors always to hold the hook (15) in the position shown in FIG. 1, in which it bears under spring force on a stop, not shown in any more detail, on the holding device (7). In this position, the hook end (17) remains at a distance from the housing (1)** of the fluid friction clutch, so that said housing can rotate with the clutch fan blades freely and according to the degree of filling.

Moreover, it can be seen from FIG. 4 that the nose (17) of the hook (15) is bevelled on one side. In this case, the bevel is made opposite to the direction of rotation (26) indicated in FIG. 4, so that, when the catch hook (15) is actuated, this nose (17) snaps in a simple way into the interspace (21) between two ribs (4).

Figure 3:
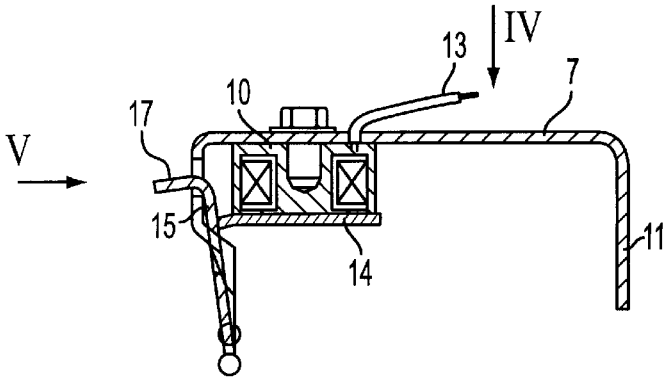
FIG. 3 shows an illustration of the locking device of FIG. 1, but in the position for retaining the fan wheel.

However, when the electromagnet (10) is made live, the hook (15) is brought, via the wing (14) fastened to it and coming to bear on the electromagnet (10), into the position according to FIG. 3, in which, as can be seen in FIG. 2, the free end (17) can engage into the interspace (21) between two adjacent cooling and reinforcing ribs (4) and thus prevents the clutch housing from rotating.

Figure 6:
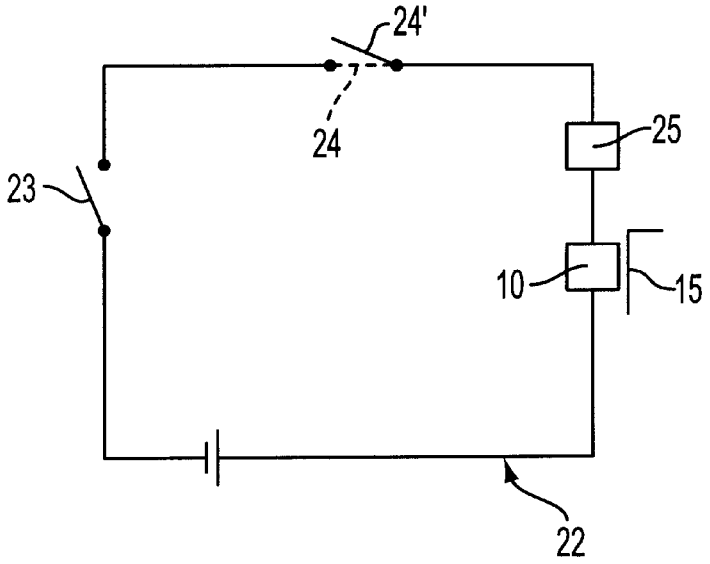
FIG. 6 shows a diagrammatic illustration of a circuit for the supply of energy to the locking device.

The design, then, in a first embodiment according to FIG. 6, is such that the electromagnet (10) is located in an electrical circuit (22), in which the ignition lock together with the switch (23) for the starter is also arranged. Furthermore, a switch (24) opening as a function of temperature and a delay element (25) are provided in the circuit. The temperature-dependent switch (24) changes over to its open position (24'), for example when a coolant temperature of 110° C. is reached, but, at coolant temperatures below this, is closed, as shown by broken lines in FIG. 6. Consequently, when the switch (23) is actuated in order to start the vehicle, the electromagnet (10) is energized and the hook (15) changes over to its position according to FIG. 3. In this position, it blocks the housing (1) of the fluid friction clutch (6), said housing being provided with the fan blades, and thus prevents the fan from corotating after the engine has started.

If the coolant temperature of, for example, 110° C. is reached after some operating time, the switch (24) opens and the magnet (10) becomes dead. The hook (15) assumes its position according to FIG. 1. The fluid friction clutch (6) works in the normal way and cuts in the fan to a greater or lesser extent.

In order, when the engine is restarted, to prevent the catch hook (15) from being actuated despite the still rotating clutch, thereby possibly resulting in damage to clutch and hook, a delay element (25) is provided, said delay element preventing actuation of the electromagnet (10) for a specific time which is configured in such a way that, by the expiry of this time, the clutch has reliably come to a definite stop or to such a low rotational speed that cutting in the locking device no longer causes damage. This may be important, for example, when the coolant temperature has not yet reached the above-mentioned temperature of 110° C. and therefore the switch (24) has remained in its closed position represented by broken lines. This may be the case when the vehicle has initially been moved only a short distance or the coolant temperature has cooled below said value again, for example on a downhill run. In such cases, the delay element (25) prevents the device from being damaged.

Figure 7:
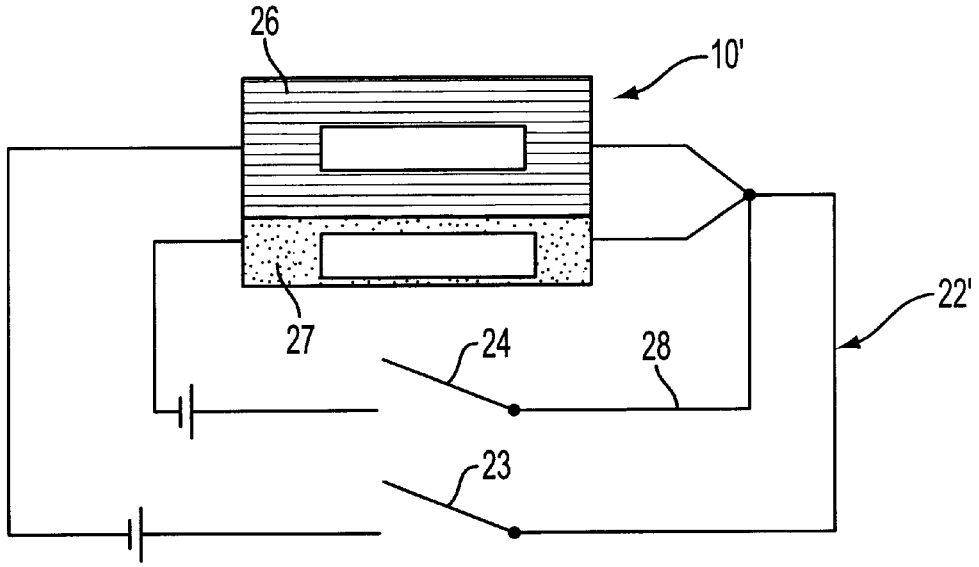
FIG. 7 shows an alternative version of the circuit according to FIG. 6.

FIG. 7 shows an alternative version of the circuit diagram according to FIG. 6. Here, as in the first exemplary embodiment, an electromagnet (10') is arranged in the electrical circuit (22'), and the switch (23) of the ignition lock for actuating the starter is provided in the circuit (22'). In this case, however, the coil of the electromagnet (10') consists of a trip winding (26) and of a restraining winding (27) which are connected in parallel, the switch (24) acting as a function of temperature being arranged in the additional circuit (28). The restraining winding (27) and the trip winding (26) are designed in such a way that they can exert the triggering force necessary for actuating the catch hook (15) only when they are both live. This design then results in the following mode of operation:

1st case—The temperature of the coolant is lower than 50° C.

In this case, the temperature-dependent switch (24) is closed, so that restraining winding (27) becomes live via the circuit (28). When the switch (23) on the ignition lock for the starter is actuated, the circuit (22') is also closed and the trip winding (26) becomes live. Since both windings (26 and 27) are live, the catch hook (15) can be actuated. It retains the fan.

When the winding (26) becomes dead during the opening of the switch (23) for actuating the starter, that is to say after the starting of the engine, the winding (27) maintains the retention of the fan by the catch hook (15). Its force is dimensioned in such a way that it can exert this restraining effect. When a coolant temperature higher than 110° C. is reached, the switch (24) opens. The restraining winding (27) also becomes dead, and the fan is released.

2nd case—Coolant temperature higher than 50° C., but lower than 110° C.

Here, the temperature-dependent switch (24) opens the circuit (28). The switch (24) is closed. When the switch (23) for the starter is actuated, both windings (27 and 26) become live, as in the first case. In this case too, the catch hook (15) is actuated and the fan is retained. After the engine has run, the switch (23) opens, but the restraining winding (27) maintains the retention of the fan. When the coolant temperature of 110° C. is reached, the switch (24) opens, the restraining winding (27) becomes dead and the fan is released.

3rd case—Coolant temperature higher than 110° C.

In this case, the temperature-dependent switch (24) is open. The circuit (28) is opened and the restraining winding (27) is therefore dead. When the starter switch (23) is actuated in this case, the trip force of the winding (26) alone is not sufficient to actuate the catch hook (15). No retention of the fan occurs. If the starter switch (23) is also opened, the trip winding (26) also becomes dead, so that the entire electromagnet (10'), that is to say the actuating member together with the catch hook (15), remains unactuated. Retention of the fan is therefore not possible above a coolant temperature of 110° C.

The solution shown in FIG. 7 thus additionally has the advantage that, even if the thermostatic switch (24) is defective, retention of the fan cannot occur, so that, in the event of a fault, the cooling of the engine is always ensured (fail safe).

As becomes immediately clear, one of the main advantages of the arrangement according to the invention is that the entire detent device can also be mounted subsequently in a simple way. For this purpose, it is merely necessary to screw on the holding device (7) at a fixed location and connect the electromagnet (10) into the circuit of the ignition lock. Whenever the engine is started at a coolant temperature which is not yet sufficiently high, a corotation of the fan is then automatically prevented, until the fan power becomes necessary in order to cool the engine coolant.

The exemplary embodiment described makes use of an electromagnet in cooperation with a specially designed pivoting hook. It is also possible, of course, to provide electromagnets or even actuating pistons, activated from the electric ignition circuit, which press corresponding detent pins into the interspaces of the cooling ribs of the fan wheel. The critical factor is that even such actuating members are coupled to the ignition circuit and can be mounted via holding devices which also allow subsequent mounting, without presupposing design changes on the fluid friction clutches.

We claim:

1. A fan assembly for an internal combustion engine of a vehicle having an ignition circuit, including an ignition lock and a starter switch for starting the engine, the fan assembly comprising:

a fluid friction clutch driven by a drive shaft of the engine, said fluid friction clutch having a clutch housing defining a fan wheel having fan blades, and a locking device for locking said fan wheel, wherein said locking device comprises an actuator comprising an electromagnet, an electrical circuit connected to the actuator and to the ignition circuit containing the ignition lock and the starter switch, a detent element associated with the actuator that engages directly with said clutch housing to lock said fan wheel in response to actuation of the ignition lock and energization of the actuator, to prevent said fan wheel from rotating during starting of the engine, and a first switch included in the electrical circuit connected to the actuator that is open in response to a predetermined temperature of engine coolant.

2. The fan assembly according to claim 1, wherein said electrical circuit further comprises a delay element that delays the energization of said actuator for a predetermined period of time after actuation of the ignition lock sufficient to assure that the clutch housing has come to rest.

3. The fan assembly according to claim 1, wherein said electrical circuit comprises first and second electrical circuits electrically connected in parallel to one another, said electromagnet comprises a trip winding and a restraining winding, said trip winding being positioned in one of said first and second electrical circuits and said restraining winding being positioned in the other of said first and second electrical circuits, said windings being separately actuatable by said ignition lock and said first switch, and wherein both of said windings must be actuated to actuate said detent element.

4. The fan assembly according to claim 3, wherein said first switch is located in the electrical circuit containing said restraining winding.

5. The fan assembly according to claim 1, wherein said temperature is about 110° C.

6. The fan assembly according to claim 1, wherein said detent element comprises a protruding member and said clutch housing includes at least one indentation into which said protruding member engages to produce said direct engagement of the actuator with said clutch housing.

7. A fan assembly for an internal combustion engine of a vehicle having an ignition circuit, including an ignition lock and a starter switch for starting the engine, the fan assembly comprising:

a fluid friction clutch driven by a drive shaft of the engine, said fluid friction clutch having a clutch housing defining a fan wheel having fan blades, and a locking device for locking said fan wheel, wherein said locking device comprises an actuator, an electrical circuit connected to the actuator and to the ignition circuit containing the ignition lock and the starter switch, and a detent element associated with the actuator that engages directly with said clutch housing to lock said fan wheel in response to actuation of the ignition lock and energization of the actuator, to prevent said fan wheel from rotating during starting of the engine, wherein said clutch housing includes a plurality of cooling ribs having an interspace formed therebetween, and wherein said detent element is a catch hook that engages into said interspace.

8. The fan assembly according to claim 7, further comprising a holding device for holding said actuator, wherein said catch hook is pivotally mounted on said holding device.

9. The fan assembly according to claim 7, wherein said holding device includes a portion for mounting the holding device in a fixed location associated with the engine.

10. The fan assembly according to claim 7, wherein said catch hook comprises a projecting wing made of a magnetically active material and cooperates with said actuator.

11. The fan assembly according to claim 10, wherein said holding device comprises a return spring that engages said catch hook.

12. The fan assembly according to claim 11, wherein said return spring is a leaf spring firmly mounted on said holding device and surrounds said catch hook laterally.

13. A fan locking kit for retrofitting to an internal combustion engine of a vehicle having an ignition circuit, including an ignition lock and a starter switch for starting the engine, and a fluid friction clutch driven by a drive shaft of the engine, said fluid friction clutch having a clutch housing defining a fan wheel having fan blades, the fan locking kit comprising:

a locking device for locking said fan wheel, comprising an actuator comprising an electromagnet, an electrical circuit for connection to the actuator and to the ignition circuit containing the ignition lock and the starter switch, a detent element associated with the actuator that engages directly with said clutch housing to lock said fan wheel in response to actuation of the ignition lock and energization of the actuator, to prevent said fan wheel from rotating during starting of the engine, and a first switch included in the electrical circuit connected to the actuator that is open in response to a predetermined temperature of engine coolant; and a mounting device for holding said actuator and having a portion for mounting in a fixed position with respect to the engine.

14. The fan locking kit according to claim 13, wherein said clutch housing includes a plurality of cooling ribs having an interspace formed therebetween, and wherein said detent element is a catch hook that engages into said interspace.

* * * * *